US008535205B2

(12) United States Patent
Barnes

(10) Patent No.: US 8,535,205 B2
(45) Date of Patent: Sep. 17, 2013

(54) HAND THERAPY EXERCISE TOOLS, AND METHODS OF CONSTRUCTING AND UTILIZING SAME

(75) Inventor: Carolyn Sarah Barnes, Scottsdale, AZ (US)

(73) Assignee: Elliott Goldberg, Scarsdale, NY (US)

( * ) Notice: Subject to any disclaimer, the term of this patent is extended or adjusted under 35 U.S.C. 154(b) by 152 days.

(21) Appl. No.: 13/204,666

(22) Filed: Aug. 6, 2011

(65) Prior Publication Data

US 2011/0287900 A1 Nov. 24, 2011

Related U.S. Application Data

(62) Division of application No. 11/811,840, filed on Jun. 12, 2007, now Pat. No. 8,096,924.

(51) Int. Cl.
*A63B 23/14* (2006.01)
*A63B 23/16* (2006.01)

(52) U.S. Cl.
USPC ..... 482/44; 601/40

(58) Field of Classification Search
USPC ..... 482/44–50, 92, 148; 601/23, 33, 601/40
See application file for complete search history.

(56) References Cited

U.S. PATENT DOCUMENTS

| | | | | | |
|---|---|---|---|---|---|
| 2,674,758 | A | * | 4/1954 | Fay | 15/160 |
| 2,908,246 | A | | 10/1959 | Alexander et al. | |
| 3,604,229 | A | * | 9/1971 | Wake | 70/107 |
| 4,496,510 | A | * | 1/1985 | Hanson et al. | 264/257 |
| 4,569,815 | A | | 2/1986 | Rentz et al. | |
| 4,901,464 | A | * | 2/1990 | Banoun | 42/95 |
| 5,427,528 | A | | 6/1995 | Anderson et al. | |
| 5,446,075 | A | | 8/1995 | Gibbon | |
| 5,472,994 | A | | 12/1995 | Micallef et al. | |
| 5,693,689 | A | | 12/1997 | Gibbon | |
| 5,755,648 | A | | 5/1998 | Kildani | |
| 5,794,627 | A | | 8/1998 | Frantz et al. | |
| 5,820,522 | A | | 10/1998 | Smallwood et al. | |
| 5,890,999 | A | | 4/1999 | Kildani | |
| 6,233,771 | B1 | * | 5/2001 | Hortel et al. | 8/150 |
| 6,391,941 | B1 | | 5/2002 | Williams | |
| 6,454,681 | B1 | | 9/2002 | Brassil et al. | |
| D530,594 | S | * | 10/2006 | Soller et al. | D8/313 |
| 7,124,882 | B1 | * | 10/2006 | Jadydy | 206/234 |
| D554,315 | S | * | 10/2007 | Schouten | D32/52 |
| D578,262 | S | * | 10/2008 | Trotter et al. | D32/52 |
| 7,618,349 | B1 | | 11/2009 | Muderick | |
| 7,666,942 | B2 | | 2/2010 | Minuto et al. | |
| 2004/0072653 | A1 | | 4/2004 | Minuto et al. | |
| 2004/0082886 | A1 | | 4/2004 | Timpson | |
| 2004/0200748 | A1 | * | 10/2004 | Klassen et al. | 206/368 |
| 2005/0250620 | A1 | | 11/2005 | Minuto et al. | |
| 2008/0276396 | A1 | | 11/2008 | Lucero | |
| 2009/0111662 | A1 | | 4/2009 | Wagner et al. | |
| 2009/0263766 | A1 | * | 10/2009 | Ozuna et al. | 434/100 |
| 2010/0267523 | A1 | | 10/2010 | Wilkinson et al. | |
| 2011/0036746 | A1 | | 2/2011 | Bear | |

* cited by examiner

*Primary Examiner* — Stephen Crow
(74) *Attorney, Agent, or Firm* — Weiner & Burt, P.C.; Irvina M. Weiner; Pamela S. Burt

(57) ABSTRACT

A multi-functional group of hand/forearm exercise tools wherein each tool permits the user to strengthen one or more muscles associated with the hand/forearm of the user, and/or to increase radial and ulnar deviation and forearm pronation and supination, or permits the user to mimic a functional task, such as turning a door knob, opening a bottle cap, inserting and turning a key, turning and tightening a nut, and turning and tightening a bolt.

18 Claims, 7 Drawing Sheets

Pegs (Set of Ten)

Basic Form: Set of Ten will vary in size by thickness of shaft.

View of Side (1) View of Side (2)

HAND THERAPY EXERCISE TOOLS, AND METHODS OF CONSTRUCTING AND UTILIZING SAME

CROSS-REFERENCE TO RELATED APPLICATIONS

The present application is a divisional of U.S. patent application Ser. No. 11/811,840 filed Jun. 12, 2007 now U.S. Pat. No. 8,096,924.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

The present invention relates generally to novel hand therapy exercise tools, and methods of constructing and utilizing same.

More particularly, the present invention relates to the aforementioned tools and methods used in conjunction with therapeutic putty of various resistances.

Heretofore, a patient may arrive at a hand therapy clinic status-post, for example, a distal radius fracture. Such a patient may have been splinted for six weeks or so. Typically, such a patient has limitations of radial/ulnar deviation, fine motor skills, and functional deficits. Before the advent of the present invention, the tools and techniques available to patient and therapist were limited and not very effective.

The prior, but not necessarily relevant, art is exemplified by:

Smallwood et al. U.S. Pat. No. 5,820,522;

Williams U.S. Pat. No. 6,391,941; and

Minuto et al. US Patent Application Publication US2004/0072653.

The present invention solves the aforementioned problems and other problems.

It is a desideratum of the present invention to avoid the animadversions of conventional hand therapy exercise tools and techniques.

SUMMARY OF THE INVENTION

The present invention provides a hand therapy method, comprising the steps of: providing a first therapeutic putty having a first predetermined resistance; providing a first predetermined hand therapy exercise tool; inserting a first predetermined portion of said tool into first putty; permitting a patient to cause said tool to move a first predetermined trajectory within and relative to said first putty until said patient can do so with ease; removing said tool from said first putty; providing a second therapeutic putty having a second predetermined resistance which is greater than said first predetermined resistance; inserting said first predetermined portion of said tool into said second putty; and permitting the patient to cause said tool to move second predetermined trajectory within and relative to said second putty until said patient can do so with ease.

The present invention also provides a hand therapy exercise tool, comprising, in combination: a tool member having a first predetermined portion having a first predetermined shape and configuration for insertion into a therapeutic putty; said tool member having a second predetermined portion having a second predetermined shape and configuration enabling a patient to manipulate said tool member to cause said tool to move in a predetermined trajectory within and relative to said putty; and said first predetermined shape and configuration of said first portion providing a predetermined resistance to said movement of said tool within and relative to said putty.

It is a primary object of the present invention to provide functional hand exercise equipment.

Another object of the invention is to provide a set of various shaped hand therapy exercise tools which are used with graded resistant putty Other objects, advantages, and features of the present invention will become apparent to those persons skilled in this particular area of technology and to other persons after having been exposed to the present patent application when read in conjunction with the accompanying patent drawings.

DETAILED DESCRIPTION OF THE INVENTION

The invention provides novel, various-shaped hand therapy exercise tools 1-13 and methods of using same in treating hand/forearm conditions, such as, for example, tendon lacerations, finger/wrist fractures, finger amputations, carpel tunnel syndrome, tendonitis, arthritis, crush injuries, RSD, etc.

The tools 1-13 are specifically designed to be used with graded-resistant therapeutic putty 14. The putty 14 provides functional simulation with graded resistance during a therapeutic exercise program. The putty 14 comes in various thicknesses which provide various resistances to moving a first predetermined portion 15-41 of the tools 1-13 therein and/or therethrough.

The tools 1-13 provide the patient with functional simulation and graded resistance for various tasks, e.g., opening a door (knob turn), opening a bottle of water (smaller knob turn), work limitations with tightening a bolt, limitations with turning a key, etc.

In describing the tools 1-13 and the various exercises with which they can be used, reference is made hereinbelow to the accompanying drawings and photos together with the text juxtaposed to such photos, which text is incorporated in this detailed description by reference thereto to best facilitate understanding the tools 1-13 and their uses.

Figure 1:
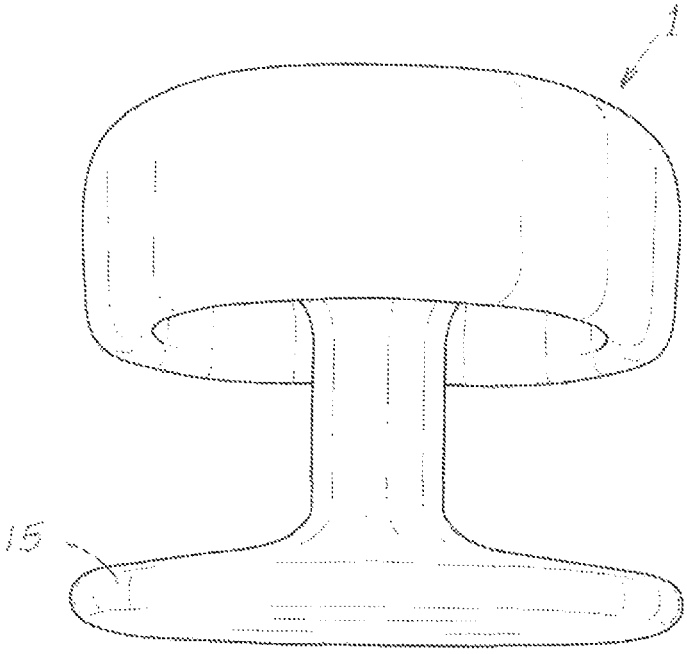
FIG. 1 is a perspective view of a knob turn tool.
Figure 2:
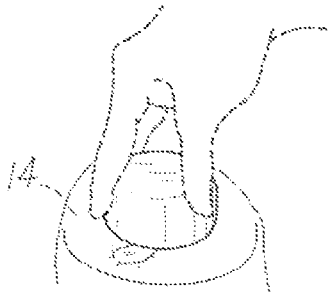
FIG. 2 is shows the FIG. 1 tool being used with fingertips.
Figure 3:
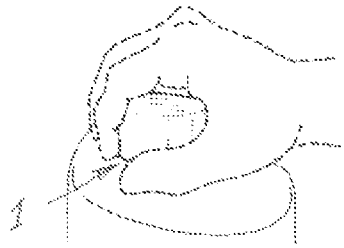
FIG. 3 is shows the FIG. 1 tool being used with the basic grip.

With reference to FIGS. 1-3, there is shown a knob turn tool 1 having a first predetermined portion 15 having a predetermined shape and configuration for insertion into the therapeutic putty 14. The tool 1 can be used to improve various conditions of the hand/forearm as illustrated with reference to FIGS. 1-3. The tool 1 may be made out of a hard plastic. The base 15 is narrowed at the end to aid with moving through the resistant putty 14. The knob shape and size of tool 1 are formed to simulate a basic jar top, lid and doorknob size. Tool 1 may be modified by adding a soft grip surface to increase ease with grasp. Resistance may be graded in by increasing the thickness of putty 14 and by adjusting the speed in which each exercise is performed. The knob turn piece 1 is inserted into the putty 14 by placing it on top of a mound of putty and gently pushing down to insert the base 15 into the resistance. The top portion is then used as a functional exercise to rotate, simulating the activity. The object requires the user to reinsert the object into the putty at various times throughout the exercise to continue having resistance. The exercise time, resistance, and form of exercise is determined by the treating therapist.

Figure 4:
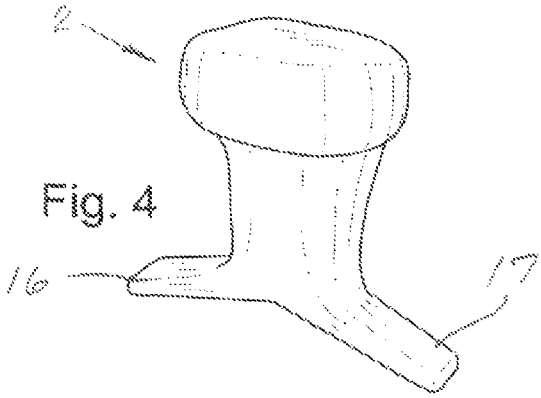
FIG. 4 shows a small knob turn tool.
Figure 5:
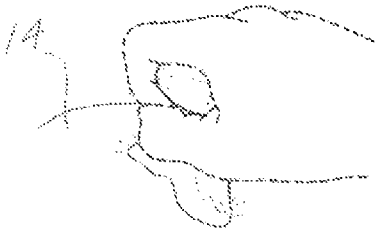
FIG. 5 shows the FIG. 4 tool being used with the basic grip.
Figure 6:
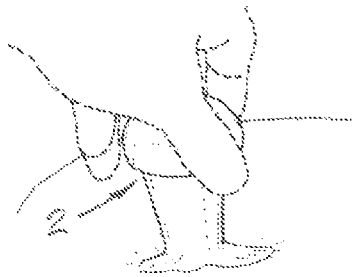
FIG. 6 shows the FIG. 4 tool being used with fingertips.

With reference to FIGS. 4-6, there is shown a small knob turn tool 2 having first predetermined portions 16 and 17 having a predetermined shape and configuration for insertion into the therapeutic putty 14. The tool 2 can be used to improve various conditions of the hand/forearm as illustrated with reference to FIGS. 4-6. Tool 2 may made out of a strong plastic. The small knob shape and size of tool 2 are formed to simulate a basic lid to a bottle, including variations such as a water bottle, a soda bottle, a beer bottle, and a pipe top. Tool 2 may be modified by adding a soft grip surface to increase ease with the grip. Resistance may be graded in by increasing the thickness of putty 14 and by adjusting the speed in which each exercise is performed. The treatment protocol may be determined by the treating therapist. The small knob turn piece 2 is inserted into the putty 14 by placing it on top of a mound of putty and gently pushing down to insert the bases 16 and 17 into the resistance putty 14. The top portion is then used as a functional exercise to rotate/simulate an activity. The object is to require the patient to reinsert tool 2 into the putty at various times throughout the exercise to continue having resistance.

Figure 7:
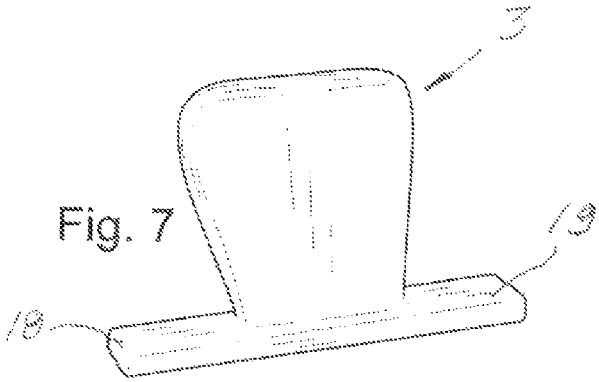
FIG. 7 shows a key turn tool.
Figure 8:
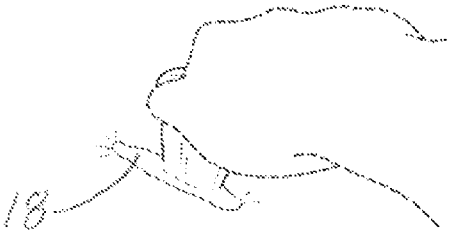
FIG. 8 shows the basic key turn exercise.
Figure 9:
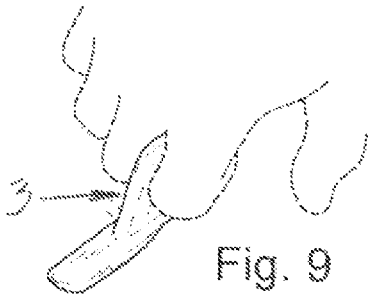
FIG. 9 shows the FIG. 7 tool being used with the intrinsic function between digits.

With reference to FIGS. 7-9, there is shown a key turn tool 3 having first predetermined portions 18 and 19 having a predetermined shape and configuration for insertion into the therapeutic putty 14. The tool 3 can be used to improve various conditions of the hand/forearm as illustrated with reference to FIGS. 7-9. Tool 3 may be made out of a hard plastic. The bases 18 and 19 are tapered at the ends to ease with moving through the resistant putty 14. The top of tool 3 is shaped to simulate a key-type object. Resistance may be graded in by increasing the thickness of putty 14 and by adjusting the speed in which each exercise is performed. The key turn piece 3 is inserted into the putty 14 by placing it on top of a mound of putty and gently pushing down to insert the bases 18 and 19 into the resistance putty 14. The top portion is then used to simulate functional exercises by rotating and/or pulling out of putty 14. The object is to require the patient to reinsert the tool 3 into the putty at various times throughout the exercise to continue having resistance. The exercise time, resistance, and form of exercise may be determined by the treating therapist.

Figure 10:
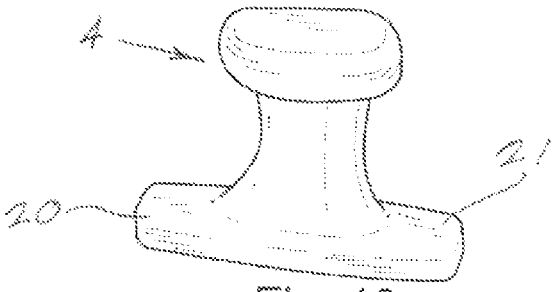
FIG. 10 shows a bolt turn tool.
Figure 11:
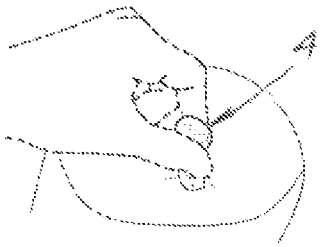
FIG. 11 shows the FIG. 10 tool being used for fine motor skills.
Figure 12:
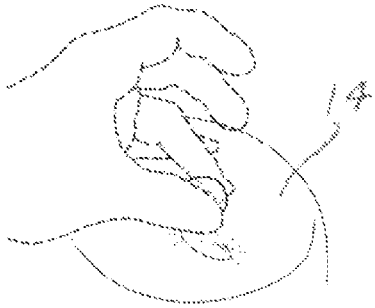
FIG. 12 shows the FIG. 10 tool being used to improve fine motor coordination of individual digits.

With reference to FIGS. 10-12, there is shown a bolt turn tool 4 having first predetermined portions 20 and 21 having a predetermined shape and configuration for insertion into the therapeutic putty 14. The tool 4 can be used to improve various conditions of the hand/forearm as illustrated with reference to FIGS. 10-12. Tool 4 may be made out of hard plastic. The bases 20 and 21 are narrowed at their ends to ease with moving the tool 4 through the resistant putty 14. The knob shape and size of tool 4 are formed to simulate tightening a bolt. This can also aid in increasing and strengthening fine motor skills. The base shape and size are smaller to decrease the required force to push the tool 4 through the resistant putty 14. The bolt turn piece 4 is inserted into the putty 14 by placing it on top of a mound of putty and gently pushing down to insert the bases 20 and 21 into the resistance putty 14. The top portion of tool 4 is then used for functional exercises with rotating tool 4 through the resistance putty 14, simulating the activity. The object is to requires the user to reinsert the tool 4 into the putty and rotate it at various times throughout the exercise to continue having resistance. The exercise time, resistance of putty, and form of exercise may be determined by the treating therapist.

Figure 13:
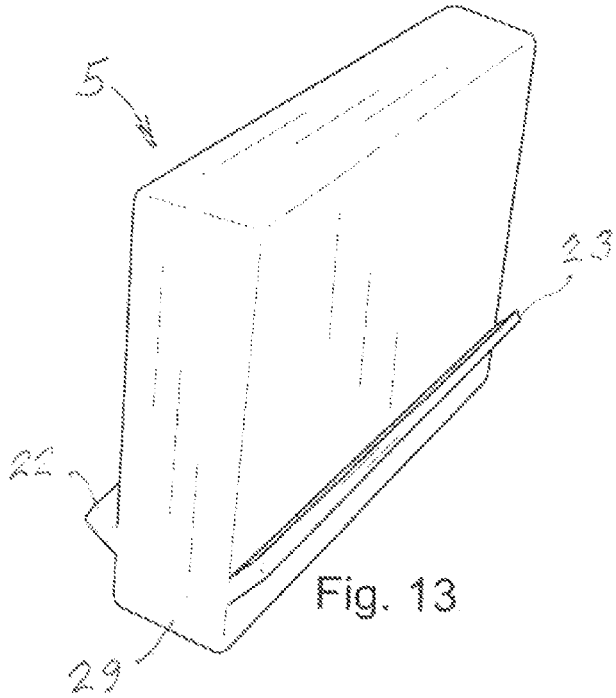
FIG. 13 shows a plank tool.
Figure 14:
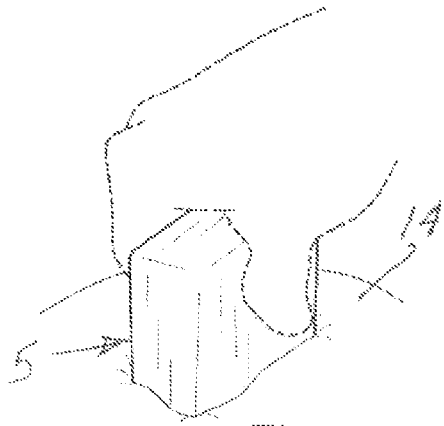
FIG. 14 shows the FIG. 13 tool being used in the intrinsic plus position.

With reference to FIGS. 13 and 14, there is shown a plank tool 5 having first predetermined portions 22, 23 and 29 having a predetermined shape and configuration for insertion into the therapeutic putty 14. The tool 5 can be used to improve various conditions of the hand/forearm as illustrated with reference to FIGS. 13 and 14. Tool 5 may be made out of a hard plastic. Resistance may be graded in by increasing the thickness of putty 14 and by adjusting speed in which each exercise is performed. The purpose of piece 5 is to simulate an intrinsic plus position of the hand. This produces a resistive exercise focusing on the intrinsic muscles of the hand. This can be used to simulate pulling an object out of a resistive substance, picking up an oblong object, rotating an object, and various activities performed throughout the day. Hand therapists may use this exercise to strengthen median and ulnar innervated muscles. The resistance may require the patient to replace the tool 5 in the putty 14 to continue having a resistant exercise. The tool 5 is placed into the putty by pushing/pulling/and/or rotating one end into the putty. The exercise time, resistance, and form of exercise is determined by the treating therapist.

Figure 15:
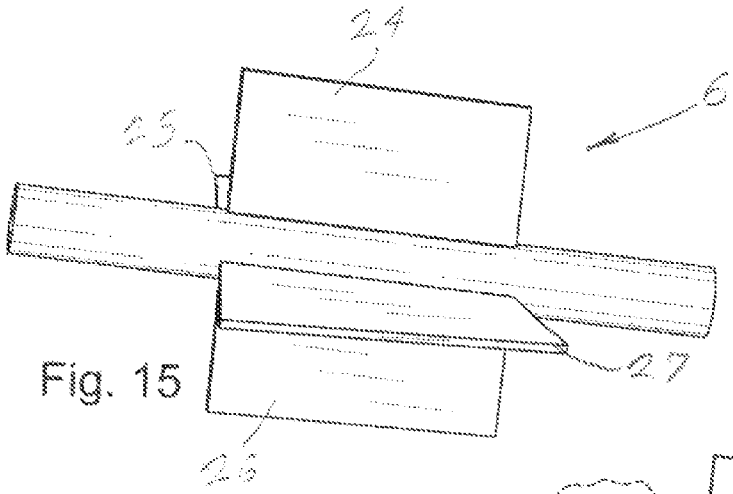
FIG. 15 shows a "T" bar tool.
Figure 16:
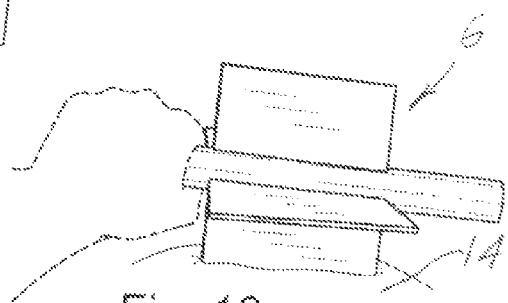
FIG. 16 shows the FIG. 15 tool being used.

With reference to FIGS. 15 and 16, there is shown a "T" bar tool 6 having first predetermined portions 24-27 having a predetermined shape and configuration for insertion into the therapeutic putty 14. The tool 6 can be used to improve various conditions of the hand/forearm as illustrated with reference to FIGS. 15 and 16. The tool 6 may be made out of a hard plastic. The resistance may be graded in by increasing the thickness of putty 14 and by adjusting the speed in which each exercise is performed. Tool 6 is used by gripping one or both ends of the circular bar and placing the extended planks 24-27 into the putty 14. The bar is then rotated forward, backward, or from side to side to create a resistant force. The exercise time, resistance, and form of exercise is determined by the treating therapist.

Figure 17:
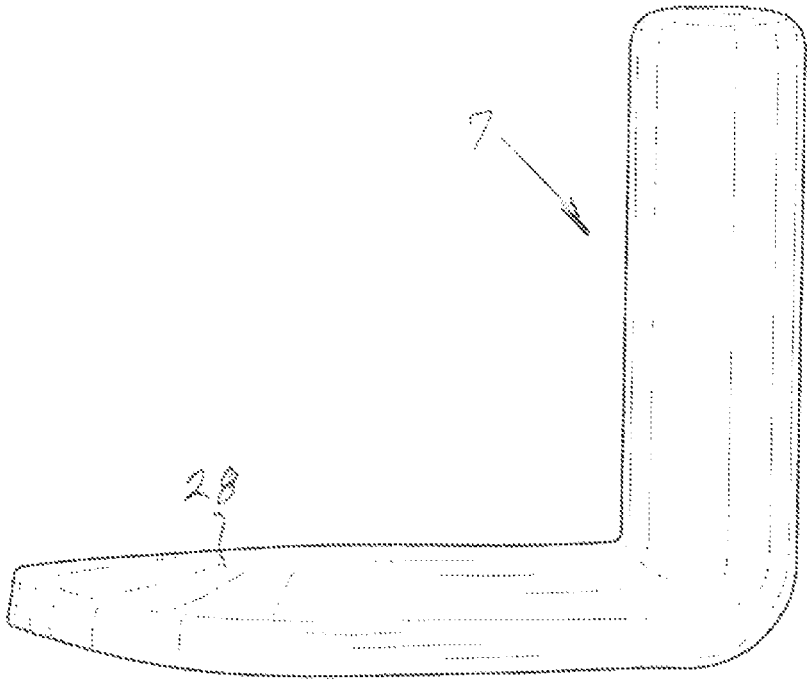
FIG. 17 shows an "L" bar tool.
Figure 18:
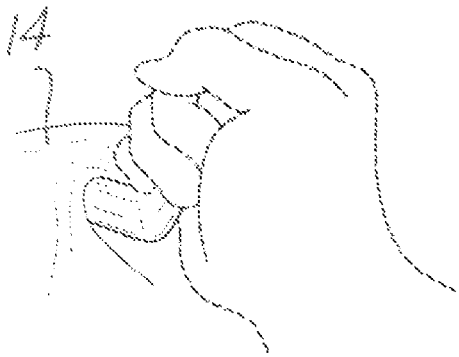
FIG. 18 shows the FIG. 17 tool being used for radial deviation.
Figure 19:
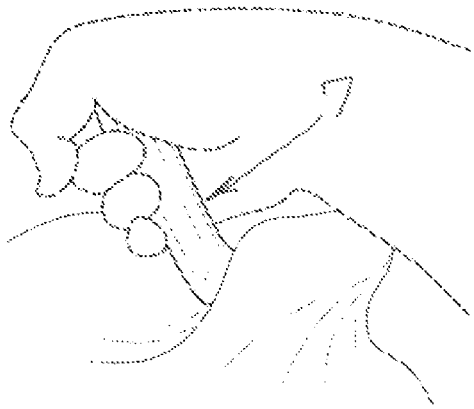
FIG. 19 shows the FIG. 17 tool being used for ulnar deviation.
Figure 20:
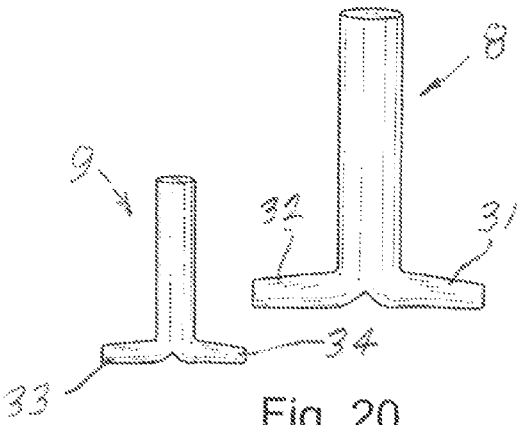
FIG. 20 shows peg tools.
Figure 21:
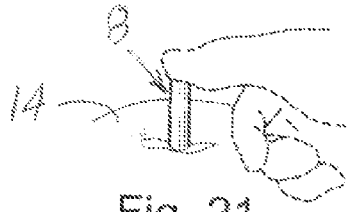
FIG. 21 shows a FIG. 20 tool being pushed down.

With reference to FIGS. 17-19, there is shown an "L" bar tool 7 having a first predetermined portion 28 having a predetermined shape and configuration for insertion into the therapeutic putty 14. The tool 7 can be used to improve various conditions of the hand/forearm as illustrated with reference to FIGS. 17-19. Tool 7 may be made out of a hard plastic. Both ends are tapered to ease with the torque required to move through the resistance putty 14. The "L" form is to allow for exercises to be performed to increase radial and ulnar deviation and forearm pronation and supination. Resistance may be graded in by increasing the thickness of putty 14 and/or by adjusting the speed in which each exercise is performed. The "L" bar 7 is placed into the putty 14 by inserting one end into the putty. The remaining end is used as a lever to pull the inserted end out of the putty. The object is to require the patient to reinsert the tool 7 into the putty at various times throughout the exercise to continue having resistance. The exercise time, resistance, and the form of exercise is determined by the treating therapist.

With reference to FIGS. 20, 21, 30 and 31, there are shown peg tools 8-10 having first predetermined portions 31-34, 40 and 41 having a predetermined shape and configuration for insertion into the therapeutic putty 14. The tools 8-10 can be used to improve various conditions of the hand/forearm as illustrated with reference to FIGS. 20, 21, 30 and 31. Tools 8-10 may made out of a hard plastic. The pegs 8-10 (e.g., a set of ten) are designed in various sizes. The intent is to provide various widths to push/pull pegs 8-10 into putty 14, and also provide turning. Each peg 8-10 has a base 31-34, 40 and 41 which is lengthened and tapered to provide appropriate resistance. Resistance may be graded in by increasing the thickness of the putty 14 and by adjusting the speed at which each exercise is performed. The dimensions of pegs 8-10 may vary to simulate various functional uses. The initial process includes pushing the pegs into the putty to insert the base. The pole of the peg is then used to rotate, pull out, or push further in. The object is to require the patient to insert, rotate, and/or re-insert the peg into the putty at various times throughout the exercise to continue having the desired resistance. The exercise time, resistance, and form of each exercise is determined by the treating therapist.

Figure 22:
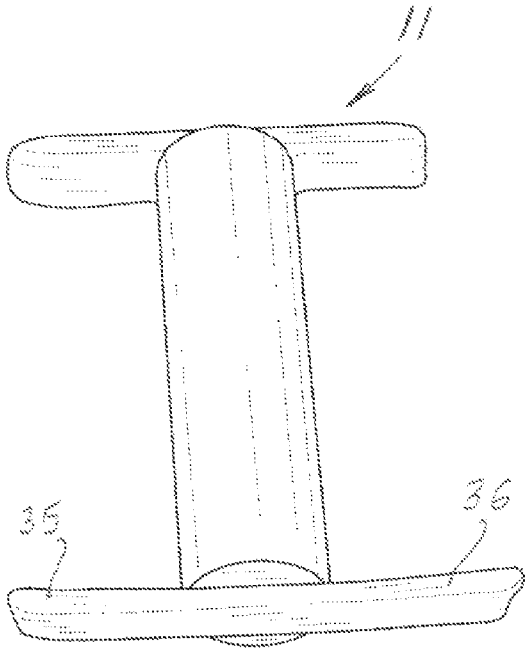
FIG. 22 shows a crank turn tool.
Figure 23:
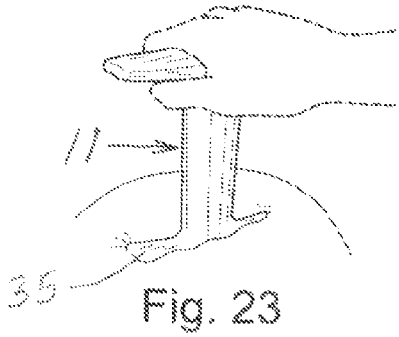
FIG. 23 shows the FIG. 22 tool being used for a top crank turn.
Figure 24:
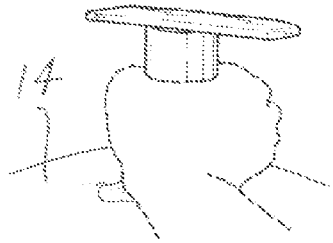
FIG. 24 shows the FIG. 22 tool being used for a shaft crank turn.

With reference to FIGS. 22-24, there is shown a crank turn tool 11 having first predetermined portions 35 and 36 having a predetermined shape and configuration for insertion into the therapeutic putty 14. The tool 11 can be used to improve various conditions of the hand/forearm as illustrated with reference to FIGS. 22-24. Tool 11 may be made of a hard plastic. The double "T" form is to simulate turning a bar. The shaft of the crank turn 11 is rounded to simulate a pipe. Resistance may be graded in by increasing thickness of putty 14 and by adjusting speed at which each exercise is performed. The crank turn 11 can be used in various ways, e.g., to insert one base into the putty and simulate a turning/tightening action; to insert one base into the putty and grip the shaft to produce a rotating action; to hold onto the shaft and place one base into the putty and produce a rotating action; etc. The object is to require the patient to insert, rotate, and/or re-insert the tool 11 into the putty at various times throughout the exercise to continue having resistance. The exercise time, resistance, and form of each exercise is determined by the treating therapist.

Figure 25:
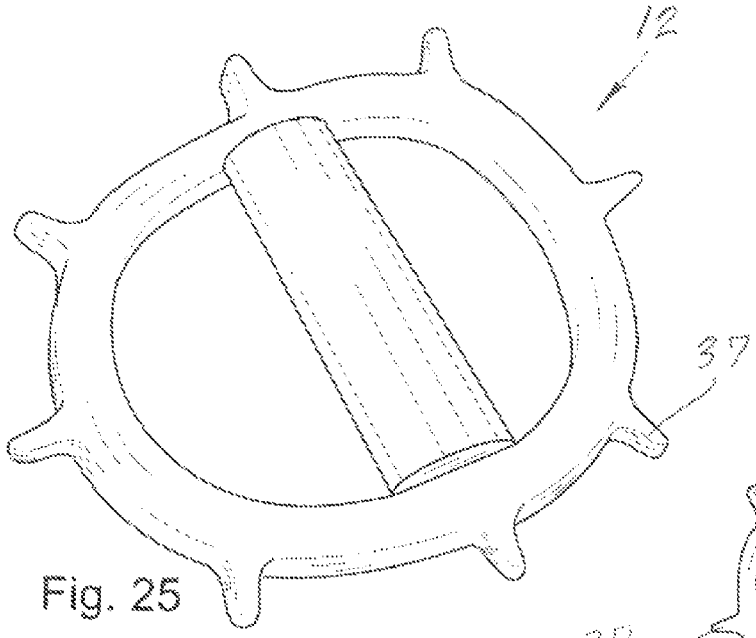
FIG. 25 shows a pro/sup wheel tool.
Figure 26:
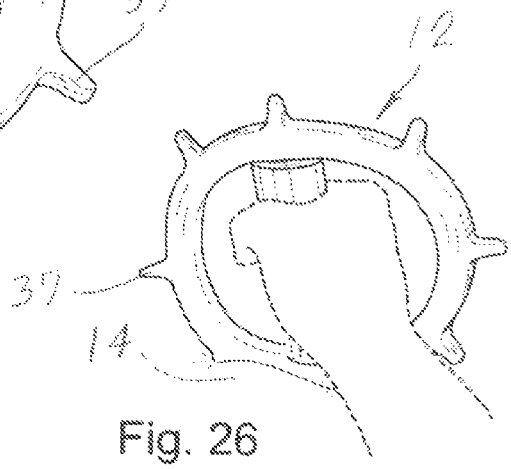
FIG. 26 shows the FIG. 25 tool being used for forearm pronation.

With reference to FIGS. 25 and 26, there is shown a pro/sup wheel tool 12 having first predetermined portions 37 having a predetermined shape and configuration for insertion into the therapeutic putty 14. The tool 12 can be used to improve various conditions of the hand/forearm as illustrated with reference to FIGS. 25 and 26. Tool 12 may made of a hard plastic, and formed as an oval to increase the time of resistance during rotation. The center bar of tool 12 is a round mass to simulate a gripping activity. Resistance may be graded in by increasing thickness of putty 14 and by adjusting the speed in which each exercise is performed. The spikes 37 of the tool 12 are inserted into the putty to provide resistance. The forearm is then rotated to produce a supination and/or pronation activity. This activity can simulate opening of a door, tightening of an object, and many other functional activities. The purpose is to require the patient to insert, rotate, and/or re-insert tool 12 into the putty 14 at various times throughout each exercise to continue having resistance. The exercise time, resistance, and form of each exercise is determined by the treating therapist.

Figure 27:
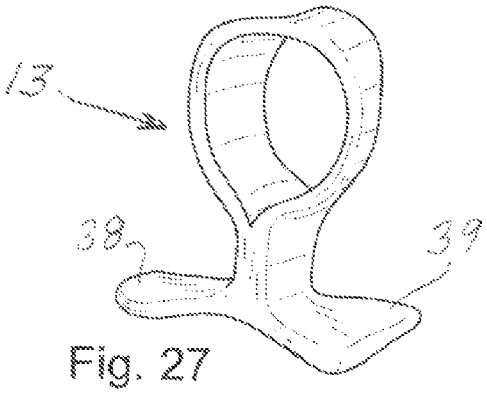
FIG. 27 shows a digit extension loop tool.
Figure 28:
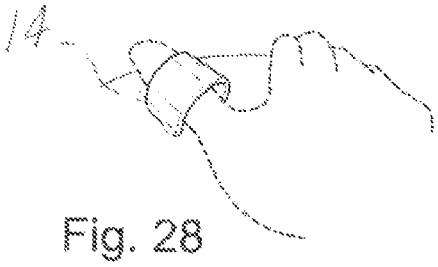
FIG. 28 shows the FIG. 27 tool being used for extensor pollicis longus isolation.
Figure 29:
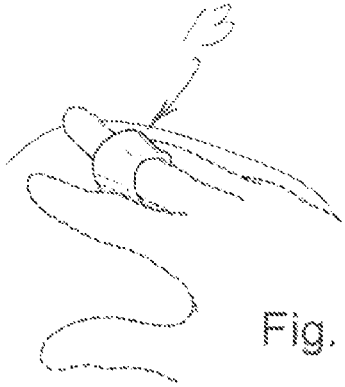
FIG. 29 shows the FIG. 27 tool being used for digit extension.
Figures 30, 31:
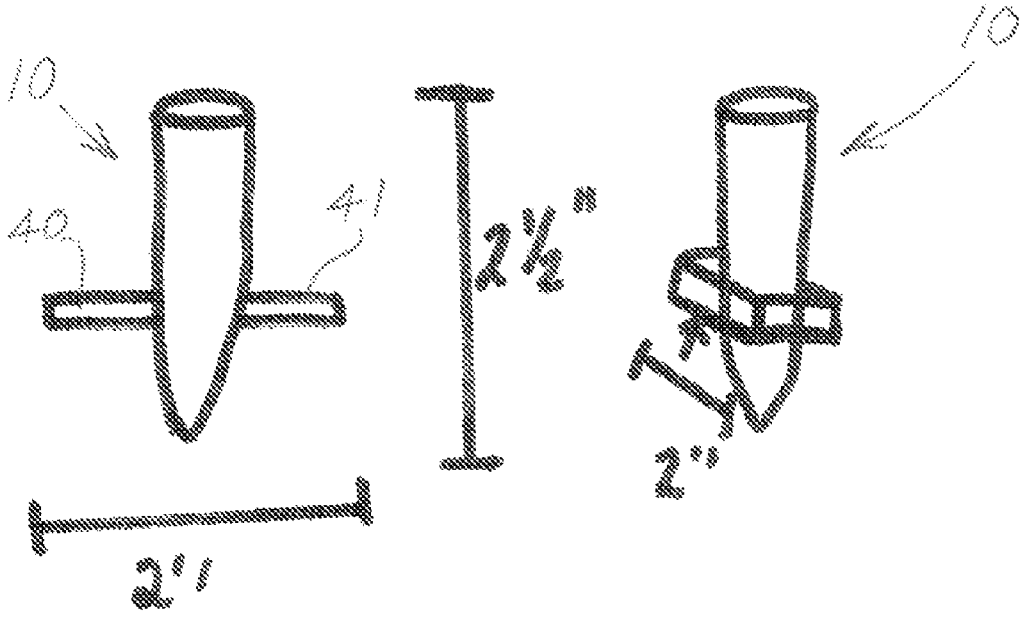
FIGS. 30 and 31 show a different embodiment of the FIG. 20 tools.

With reference to FIGS. 27-29, there is shown a digit extension loop tool 13 including first predetermined portions 38 and 39 having a predetermined shape and configuration for insertion into the therapeutic putty 14. The tool 13 can be used to improve various conditions of the digits/hand as illustrated with reference to FIGS. 27-29. Tool 13 may be made out of a hard plastic. The shape of tool 13 is formed to allow a digit to be inserted through a loop to provide a resistance with digit extension. The base 38 and 39 is in a "T" formation to grip into the putty 14 to provide resistance. The width of the loop is wide to accommodate to various sizes of digits. Resistance may be graded in by increasing the thickness of putty 14 and/or by adjusting the speed at which each exercise is performed. The base of tool 13 is pushed down into the putty to provide a resistance. The digit of choice is placed through the loop of tool 13. The digit is then extended to produce a movement of extension. The purpose is to require the patient to insert and re-insert tool 13 into the putty at various times throughout the exercise to continue having resistance. The exercise time, resistance, and form of exercise is determined by the treating therapist.

The putty 14 is provided in various resistances, e.g., soft, medium, medium-hard, hard. The tools 1-13 used in conjunction with the graded resistance putty 14 enables the patient to progress gradually with the therapy methods and exercise programs in accordance with the invention.

The invention provides a cost-effective, multi-functional group of fine/gross motor exercise equipment (tools 1-13) and unique methods of using same for clinic use. These can also be purchased by the patient to include into their home exercise program.

There have been illustrated in the accompanying drawings and described hereinabove only several of the unique and novel embodiments of the present invention which can be practiced and constructed in many different configurations, arrangements of components, sizes, shapes, and exercises therewith.

It should be understood that many changes, modifications, variations, and other uses and applications will become apparent to those persons skilled in this particular area of technology and to others after having been exposed to the present patent specification and accompanying drawings.

Any and all such changes, modifications, variations and other uses and applications which do not depart from the spirit and scope of the present invention are therefore covered by and embraced within the present invention and the patent claims set forth hereinbelow.

The invention claimed is:

1. A hand/forearm therapy exercise tool, comprising, in combination:

a graded resistant therapeutic putty;

an integral unitary device having a first predetermined portion thereof integral with and unitary with a second predetermined portion thereof;

said first predetermined portion of said integral unitary device having a first predetermined shape and configuration for insertion into said graded resistant therapeutic putty;

said second predetermined portion having a second predetermined shape and configuration enabling a patient/user to manipulate said integral unitary device to cause said first predetermined portion of said integral unitary device to move in a predetermined trajectory within and relative to said graded resistant therapeutic putty;

said second predetermined portion of said integral unitary device being shaped to permit grasping thereof by a hand, a finger, or fingers of a patient/user of said integral unitary device;

said first predetermined portion providing a predetermined resistance to movement of said integral unitary device within and relative to said graded resistant therapeutic putty when said second predetermined portion is moved by the patient/user of said integral unitary device; and said integral unitary device permits the patient/user to mimic a functional task, such as turning a door knob, opening a bottle cap, inserting and turning a key for a lock, turning and tightening a nut, and turning and tightening a bolt.

2. A set of various shaped hand/forearm therapy exercise tools for use with a grade resistant therapeutic putty, comprising, in combination:

a graded resistant therapeutic putty;

a plurality of various shaped hand/forearm therapy exercise tools;

each said hand/forearm therapy exercise tool comprises an integral unitary device having a first predetermined portion thereof integral with and unitary with a second predetermined portion thereof;

said first predetermined portion of said integral unitary device having a first predetermined shape and configuration for insertion into said graded resistant therapeutic putty;

said second predetermined portion of said integral unitary device having a second predetermined shape and configuration enabling a patient/user to manipulate said integral unitary device to cause said first predetermined portion of the hand/forearm therapy exercise tool to move in a predetermined trajectory within and relative to said graded resistant therapeutic putty;

said second predetermined portion having a shape selected from a group consisting of a bolt, a nut, a bottle cap, a key for a lock, a door knob, a peg, a digital extension loop, a pro/sup wheel, a crank, a plank, a "T" bar, and an "L" bar;

said second predetermined portion being shaped to permit grasping thereof by a hand, a finger, or fingers of a patient/user of said integral unitary device;

said first predetermined portion providing a predetermined resistance to movement of said integral unitary device within and relative to said graded resistant therapeutic putty when said second predetermined portion is moved by the patient/user of said integral unitary device; and said integral unitary device permits the patient/user to mimic a functional task, such as turning a door knob, opening a bottle cap, inserting and turning a key for a lock, turning and tightening a nut, and turning and tightening a bolt.

3. A multi-functional group of hand/forearm therapy exercise tools, wherein each hand/forearm therapy exercise tool comprises, in combination:

a graded resistant therapeutic putty;

an integral unitary device having a first predetermined portion thereof integral with and unitary with a second predetermined portion thereof;

said first predetermined portion of said integral unitary device having a first predetermined shape and configuration for insertion into said graded resistant therapeutic putty;

said second predetermined portion of said integral unitary device having a second predetermined shape and configuration enabling the user to manipulate said intrgral unitary device to cause said first predetermined portion of said said integral unitary device to move in a predetermined trajectory within and relative to said graded resistant therapeutic putty;

said second predetermined portion having a shape selected from a group consisting of a bolt, a nut, a bottle cap, a key for a lock, a door knob, a peg, a digital extension loop, a pro/sup wheel, a crank, a plank, a "T" bar, and an "L" bar;

said second predetermined portion of said integral unitary device being shaped to permit grasping thereof by a hand, a finger, or fingers of a patient/user of said integral unitary device; and said first predetermined shape and configuration of said first predetermined portion of said integral unitary device providing a predetermined resistance to movement of said integral unitary device within and relative to said graded resistant therapeutic putty when said second predetermined portion is moved by the patient/user of said integral unitary device.

4. A multi-functional group of hand/forearm therapy exercise tools according to claim 3, wherein:

each said integral unitary device permits the patient/user to mimic a functional task, such as turning a door knob, opening a bottle cap, inserting and turning a key for a lock, turning and tightening a nut, and turning and tightening a bolt.

5. A multi-functional group of hand/forearm therapy exercise tools according to claim 3, wherein:

each said integral unitary device permits the patient/user to strengthen one or more muscles associated with the hand/forearm of the patient/user, and/or to increase radial and ulnar deviation and forearm pronation and supination.

6. A hand/forearm therapy exercise tool, comprising, in combination:

a graded resistant therapeutic putty;

an integral unitary one-piece device having a first predetermined portion thereof integral with and unitary with a second predetermined portion thereof;

said first predetermined portion having a first predetermined shape and configuration for insertion into said graded resistant therapeutic putty;

said second predetermined portion having a second predetermined shape and configuration enabling a patient/user to manipulate said integral unitary one-piece device to cause said first predetermined portion of said integral unitary one-piece device to move in a predetermined trajectory within and relative to said graded resistant therapeutic putty;

said second predetermined portion having a shape of a plank;

said second predetermined portion being shaped to permit grasping thereof by a hand or fingers of a patient/user of said integral unitary one-piece device; and said first predetermined portion providing a predetermined resistance to movement of said integral unitary one-piece device within and relative to said graded resistant therapeutic putty when said second predetermined portion is moved by the patient/user of said integral unitary one-piece device.

7. The hand/forearm therapy exercise tool of claim 1, wherein:

said second predetermined portion of said integral unitary device has the shape of a bolt.

8. The hand/forearm therapy exercise tool of claim 1, wherein:

said second predetermined portion of said integral unitary device has the shape of a nut.

9. The hand/forearm therapy exercise tool of claim 1, wherein:

said second predetermined portion of said integral unitary device has the shape of a bottle cap.

10. The hand/forearm therapy exercise tool of claim 1, wherein:

said second predetermined portion of said integral unitary device has the shape of a key for a lock.

11. The hand/forearm therapy exercise tool of claim 1, wherein:

said second predetermined portion of said integral unitary device has the shape of a door knob.

12. The hand/forearm therapy exercise tool of claim 1, wherein:

said second predetermined portion of said integral unitary device has the shape of a peg.

13. The hand/forearm therapy exercise tool of claim 1, wherein:

said second predetermined portion of said integral unitary device has the shape of a digital extension loop.

14. The hand/forearm therapy exercise tool of claim 1, wherein:

said second predetermined portion of said integral unitary device has the shape of a pro/sup wheel.

15. The hand/forearm therapy exercise tool of claim 1, wherein:

said second predetermined portion of said integral unitary device has the shape of a crank.

16. The hand/forearm therapy exercise tool of claim 1, wherein:

said second predetermined portion of said integral unitary device has the shape of a plank.

17. The hand/forearm therapy exercise tool of claim 1, wherein:

said second predetermined portion of said integral unitary device has the shape of a “T” bar.

18. The hand/forearm therapy exercise tool of claim 1, wherein:

said second predetermined portion of said integral unitary device has the shape of an “L” bar.

* * * * *